United States Patent [19]

Yun

[11] Patent Number: 4,719,437

[45] Date of Patent: Jan. 12, 1988

[54] ELECTRICAL GROUND FAULT RECEPTACLE ASSEMBLY

[75] Inventor: Byung H. Yun, Chungcheong Buk-Do, Rep. of Korea

[73] Assignee: Goldstar Instrument & Electric Co., Seoul, Rep. of Korea

[21] Appl. No.: 775,361

[22] Filed: Sep. 12, 1985

[30] Foreign Application Priority Data

Mar. 6, 1985 [KR] Rep. of Korea ..... 5530[U]

[51] Int. Cl.[4] ..... H01H 73/00

[52] U.S. Cl. ..... 335/18; 335/164; 335/166

[58] Field of Search ..... 335/18, 164, 165, 166; 361/42, 45

[56] References Cited

U.S. PATENT DOCUMENTS 4,084,203 4/1978 Dietz et al. ..... 361/45

4,506,246 3/1985 Wong ..... 335/164

FOREIGN PATENT DOCUMENTS 613477 4/1935 Fed. Rep. of Germany ..... 335/18

*Primary Examiner*—E. A. Goldberg

*Assistant Examiner*—Lincoln Donovan

*Attorney, Agent, or Firm*—Cushman, Darby & Cushman

[57] ABSTRACT

A ground fault detecting circuit and trip mechanism for sensing ground fault signals and for interrupting a protection circuit. The trip mechanism includes a cross bar connected by means a pin to a pushbutton. A trip cross bar is rotatably assembled to the frame and engages the cross bar. When a ground fault is detected, a solenoid rotates the trip cross bar to release the cross bar. Two springs connecting the pin for retaining the cross bar pull the pushbutton and cross bar away from the trip cross bar to thereby free a pair of contacts to open the circuit. Subsequently, the trip mechanism can be reset by properly pushing the button to force the cross bar to engage the trip cross bar against the elastic pull of the springs.

4 Claims, 6 Drawing Figures

ELECTRICAL GROUND FAULT RECEPTACLE ASSEMBLY

BACKGROUND OF THE INVENTION

The present invention relates to a leakage current interruptor, particularly to an improved electrical ground fault receptacle assembly for protecting electric appliances from the hazards of ground fault currents by operation of a ground fault interrupting circuit.

Conventional receptacle structures employ a mechanism of a type which utilizes the electric characteristics of bimetal and solenoid to interrupt ground fault current upon occurence of ground fault. But such mechanisms have a disadvantage because ground faults can not be instantly interrupted. Thus, in the event of a short circuit or other overcurrent abnormalities, the safety of an electric appliance is not completely guaranteed.

Also, to overcome the above disadvantage, U.S. Pat. No. 4,084,203 issued to Robert E. D. Dietz etc. on Apr. 11, 1975, shows a receptacle assembly provided with a ground fault circuit interrupter having the size of an ordinary household or commercial junction box. This receptacle assembly comprises a ground fault detecting circuit for sensing a ground fault, and a coil and a trip mechanism for separating a protection circuit from the power supply whenever a ground fault occurs. This receptacle assembly was constructed so that the ground fault detecting circuit includes two differential transformers to sense a low level ground fault upon occurance of a ground fault, and to feed the ground fault detecting signal to an amplifier, and then to trigger a switching device by means of the amplified signal, thereby preventing damage of an electric appliances by ground fault.

The trip mechanism installed in this receptacle assembly is comprised so that the carrier member and the armature be coordinated with each other as a independent mechanism spaced away from the trip coil.

But, when the trip mechanism is activated to open the protecting circuit on the occurance of a ground fault, it does not instantly interrupt because the shut-off of excess current depends on the operation and interaction of numerous steps, for example, the arrangement of the coil and the armature, the arrangement of the armature and the carrier, the arrangement of the carrier and the reset switch, and the arrangement of the reset switch and the ring. The interaction of each operating component has a tendency to delay the overall function, resulting in less than complete protection of electric appliances. This is especially true since the trip mechanism is very complex in construction.

Thus, the present invention is devised so that the ground fault detecting circuit is activated by a minimum sensing current of the ground fault signal allowing the trip mechanism to instantly interrupt the ground fault current, thereby providing protection to electric appliances.

SUMMARY OF THE INVENTION

In the present invention, the ground fault detecting circuit is provided with two differential transformers to sense a lower level ground fault signal upon the occurance of a short circuit or other electric abnormalities, by applying this signal to the level comparator and the amplifier.

If the level of this detecting signal is greater than that of the predetermined reference voltage signal in the reference regulator, the level comparator compares the two signals and produces a high level signal at its output while the amplifier amplifies the above ground fault signal. Then the latch circuit latches the high level signal in response to the high level signal of the level comparator and supplies the high level output to the switching device for triggering it into conduction, thereby producing an amplified signal to operate the trip mechanism. The trip mechanism is energized by the ground fault current applied to its coil and pulls the operating bar therein. Therefore, the trip cross bar integrally coupled with the above operating bar is rotated in a clockwise direction to be separated from the cross bar connected to it, thereby interrupting the power supply source from the electric appliance.

Therefore, it is an object of the present invention to provide the electric ground fault receptacle assembly in which the ground fault detecting circuit can reliably operate at a predetermined ground fault current and, the trip cross bar and the cross bar comprised of a part of the trip mechanism can be simply separated by a ground fault.

An additional object of this invention is to provide the electric ground fault receptacle assembly which is simple in construction and economical to manufacture.

BRIEF DESCRIPTION OF THE DRAWING

Other objects, features and advantages of the invention will be apparent from the following description taken in connection with the accompanying drawing wherein.

DESCRIPTION OF THE PREFERRED EMBODIMENT OF THE INVENTION

Figure 1:
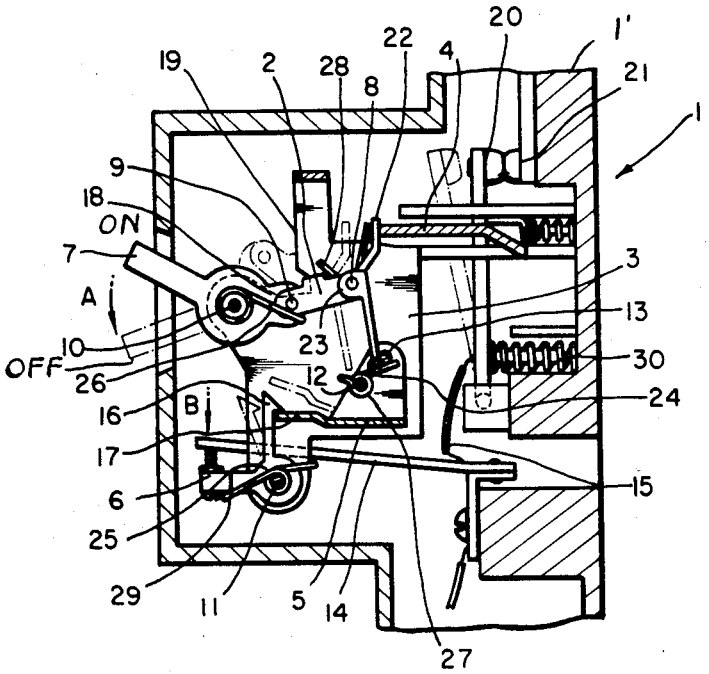
FIG. 1 (PRIOR ART)
FIG. 1 is a cross sectional view of the trip mechanism used in the conventional leakage current interrupter.

FIG. 1 shows a conventional trip mechanism utilizing a bimetal switch. In the drawing, the receptacle assembly 1 is provided with the fixed contact 21 integrally formed to the case 1' thereof. The fixed contact 21 is engaged with the moving contact 20 by means of the contact push plate 4, wherein the moving contact 20 is configurated to always be maintained in the off position by spring 30.

The contact push plate 4 moves downward along the groove formed in the case 1' by means of and in accordance with the connecting plate 2 and the pressing plate 3 in cooperation with the handle 7 when the handle 7 is in the ON position. Thus it is noted that said plate 4 serves to contact the moving contact 20 with the fixed contact 21. The contact push plate 4 is formed to be installed into the groove (not shown) provided within the case 1'. The pressing plate 3 of the trip mechanism pressing the contact push plate 4 includes the portion 22 pressing the push plate 4, the projection 23 having a hole and allowing it to be coupled with the connecting plate 2 connected to the projector 9 of the handle 7, and the portion 24 fixed to the projectio 23 and the pin 13 of the stopper 5.

The stopper 5 is rotated around pin 12 at its center by means of the pressing plate 3 and is interlocked with the jaw portion 16 of the hooking member 6 by projection 17. The hooking member 6 coupled with bimetal strip 14 is comprised of the operating portion 25, which presses said member, and the jaw portion 16 for hooking the projection 17 of the stopper 5, and said bimetal strip 14 is always forced in a direction opposite to that of arrow B by the force of the spring 29 with the pin 13 at its center.

The handle 7 of the trip mechanism is coupled with the connecting plate 2 and is integrally provide with the projection portion 18 to give a displacement to the pressing plate 3 according to the movement of the handle 7.

The spring 26 installed in the handle 7 is maintained to keep it in the off position. In the frame 19, there are integrally assembled the pressing plate 3, the connecting plate 2, the stopper 5, the handle 7 and the hooking member 6 along with pin (8, 9, 10 11, 12, 13) and the spring (26, 27, 28, 29).

The portion represented by the dashed line of FIG. 1 shows the condition in which the moving contact 20 and the fixed contact 21 are connected to each other. The projection 17 of the stopper 5 is interlocked with on the jaw portion 16 of the hooking member 6. Such operation of the above assembly is explained in detail below.

When the handle 7 projecting out from the case 1' is in the on position, the pressing plate 3 coupled to the handle 7 is moved downwardly along the groove of the frame 19 by means of the connecting plate 2 coupled to the projection 18 of the handle 7. Then the push plate 4 retains the elastic force of spring 30 installed below the moving contact 20, thereby being moved downwardly along the groove formed in the case 1' to contact the moving contact 20 with the fixed contact 21. At this time should one end of the pressing plate 3 make the stopper 5 rotate with the pin at its center, the projection 17 of the stopper 5 is interlocked with the jaw portion 16 of the hooking member 6. Thus the elastic force of the spring 30 is exerted on the contact push plate 4, the pressing plate 3 and the stopper 5 and the jaw portion 16 of the hooking member 6 suppreses the rotation of the stopper 5. Resultantly the contact of the moving contact 20 and the fixed contact 21 is maintained in the on position unless the handle 7 is in the off position.

At this time should the heating coil be heated by the over current caused by a ground fault, and the bimetal strip 14 be bent, then the projection 25 of the hooking member 6 contacted with the end of the bimetal strip 14 is pushed in the direction B of the arrow and the jaw portion 16 integrally formed to said hooking member 6 is rotated in a counter clock direction, whereby the projection 17 of the supporter 5 is separated therefrom and the supporter 5 is freed. At this time, the elastic force of spring 30, which returns the moving contact 20 to the off position, can not be restrained, whereby the trip mechanism returns to the off position to interrupt the protecting circuit from the ground fault current as shown on the dotted line. But the trip mechanism used in the conventional leakage current interrupter has a disadvantage in that ground faults can not be instantly interrupted from the protecting circuit and the assembly elements are numerous, thereby making its configuration very complex. Furthermore, as ground faults cannot be instantly interrupted, protection of electric appliance can not be completly guaranteed.

Figure 2:
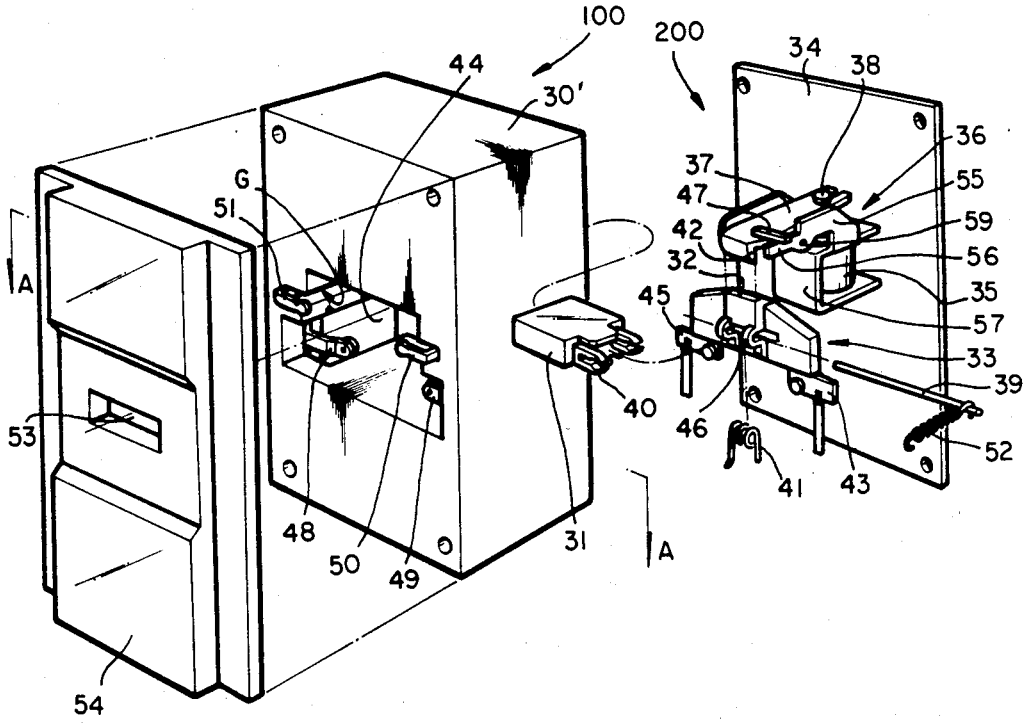
FIG. 2 is an exploded perspective view of the electric receptacle assembly in accordance with the preferred embodiment the present invention.

Thus this invention is devised to solve the problem arising from said disadvantages. FIG. 2 shows the electrical receptacle assembly 100 of this invention and additionally shows an exploded view representing the trip mechanism 200 in detail. This receptacle assembly 100 includes the case 30' integrally made from synthesized resin. This case 30' is provided with the fixed contacts 48, 49 and the spring hooks 50, 51 to which the end of the springs 52 are fixed respectively. The center portion of the case 30' has the space 44 for receiving the structural elements of the trip mechanism 200. The case 30' is provided with the groove G below the spring hook 50, 51 on both innersides of the space 44, wherein this groove G acts to guide both ends of the pin 39 on which the restoring force is applied according to the operation of the push button 31. The push button 31 made from synthesized resin is provided with the projections 40 spaced away from each other on the end surface of said push button. The end of the projection 40 has a gap into which the longitudinal portion of the pin 39 is snugly inserted.

The cross bar 33 is provided with the moving contact 43, 45 in contact with the fixed contact 48, 49, and the extension 32 which is interlocked with the jaw 42 of trip cross bar 37 during normal operation. Also, the cross bar 33 is integrally provided with the projection 46 having a hole into which the pin 39 is inserted. Thus, the push button 31 is connected to the cross bar 33 to cooperate with each other. Adjacent to and between the two projections 46 projecting from the upper surface of the cross bar 33, there is provided a groove to support the projection end of the push button 31 and to house spring 41 for applying an elastic force to the push button 31, wherein the elastic force functions maintain a constant upperward pressure against the extension 32 of an opposite direction to the pushing direction of the push button 31. The operation portion 36 of the trip mechanism 200 is integrally provided with the solenoid 35 (below referred to the trip coil), the trip cross bar 37 and the frame 57 for supporting them. The trip cross bar 37 made from synthesized resin is integrally provided with the jaw 42 which engages with the extension 32 of the cross bar 33, the stopper 47 limiting rotation, and a groove into which the operating pin 27 of the solenoid 35 is inserted. The frame 57 is bent into a "C" shape to house the trip coil 35 therein and the supporter 55 for mounting the trip cross bar 37. One side of supporter 55 has the step portion 56 limiting the downward operation of the this cross bar 37. The printed circuit board 34 is provided with the frame 57 of the operation portion 36 of the trip mechanism 200 soldered to it and the ground fault detecting circuit 300(hereafter explained in detail) for operating the solenoid. The outer cover 54 has rectangular hole 53 for inserting the push button 31.

Figure 3:
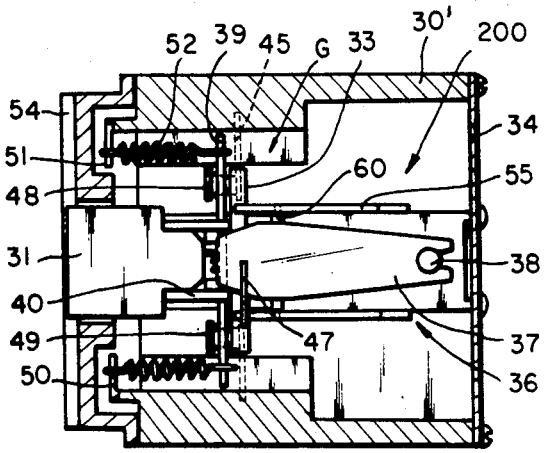
FIG. 3 is a cross-sectional view taken along the line A—A of FIG. 2.

FIG. 3 is a cross-sectional view along line A—A of FIG. 2 representing the trip mechanism 200 in a locked position. In this drawing, the cross bar 33 and the trip cross bar 37 are engaged and maintained by the elastic force of both spring 52 positioned between the pin 39 and the spring hooks 50, 51. Therefore, the fixed contact 48, 49 and the moving contact will touch each other in the on position. The grooves G formed with the space 44 of the case 30' receive the springs 52 and both ends of the pin 39 therein.

Figure 4:
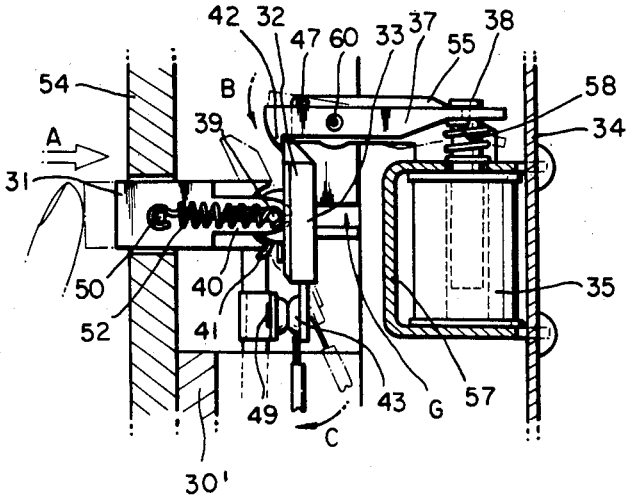
FIG. 4 is a view representing the trip mechanism in a locked position.

The operation of the trip mechanism in accordance with this invention will be explained with reference to FIG. 4 and FIG. 5. As shown in FIG. 4, first the push manually button 31 is pushed in the direction A of the arrow by the finger. Then the cross bar 33 connected to the push button 31 is lowered downward and the pin 39 mounted in the groove G maintains the position of the cross bar 33. On the other hand, because the two springs 52 are tensioned between the pin 39 integrally coupled to the cross bar 33 and the spring hoos, 50, 51 the cross bar 33 tends to return in an opposite direction to the pushing direction. Also, because the springs 52 is installed between the push button 31 and the cross bar 33, the cross bar 33 is lowered downward heading in a slanting position with the pin 39 as shown in the dotted line of FIG. 4. As this happens the extension 32 of the cross bar 33 pushes the jaw 42 of the trip cross bar 37 and at the moment the extension is engaged with the jaw 42, to which the elastic force of the spring 58 is applied, the jaw 42 is rotated in the direction B of the arrow around the pin 60 which is inserted across the support 55 of the frame 57. Then if the finger is taken off the push button 31, the extention 32 of the cross bar 33 is interlocked with the jaw 42, while the cross bar 33 is rotated in the direction C of the arrow by the elastic force of the spring 52, to thereby couple the moving contact 43 with the fixed contact 49. This operation is the process by which the trip mechanism of this invention is connected with the protection circuit.

Figure 5:
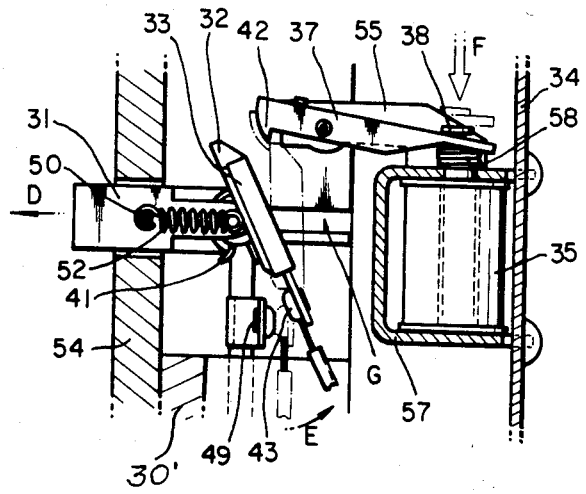
FIG. 5 is a view representing the trip mechanism in an open position.

Next, as shown in FIG. 5, an explanation will be given of the operation in which upon an unwanted occurence of a ground fault current flows into the protection circuit and the power supply source is separated from the protection circuit by the trip mechanism. On occurence of a ground fault, the ground fault detecting circuit 300 senses the ground fault signal and then this signal voltage is applied to the trip coil 35. The trip coil 35 is energized to produce a magnetic force so that the operating pin 38 is drawn into therein in direction F of the arrow against the elastic force of the spring 58. Then the trip cross bar 37 connected to one end of the operating pin 38 rotates around the pin 60 and is released from the extension 32 as shown in the solid line of FIG. 5 so that the extension 32 of the cross bar 33 is disconnected from the jaw 42 of the trip cross bar 37. Then the cross bar 33 moves backward in the direction of the arrow D by the elastic force of the spring 52, and due to the action of the spring 41 installed between the push button 31 and the cross bar 33, the moving contact 43 fixed to the cross bar 33 is rotated in the direction of the arrow E to be disengaged from the fixed contact 49, thereby forcing the trip mechanism to be in the open position. If the trip coil is deenergized, the cross bar 37 returns to the position represented in the dotted line of FIG. 5 by the restoring force of the spring 58.

Thereafter the user investigates the cause of the ground fault and removes the cause. Again the user pushes the push button to make the trip mechanism perform the operation of FIG. 4, thereby returning the leakage interrupter to the normal operating position.

Figure 6:
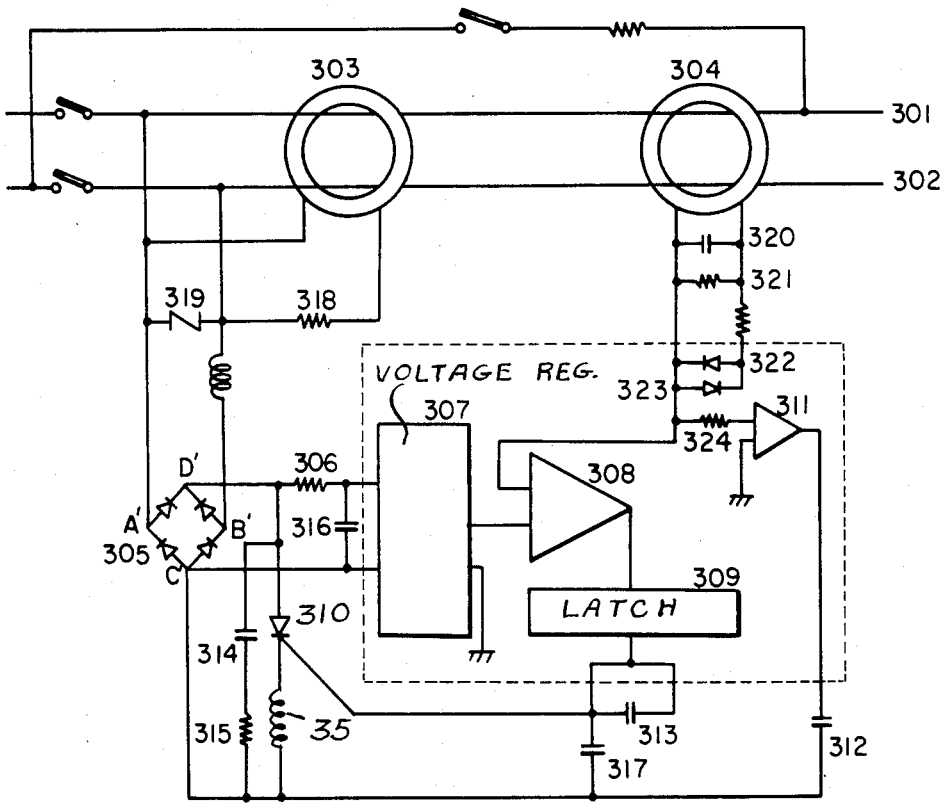
FIG. 6 is the ground fault detecting circuit under the preferred embodiment of the present invention.

Also as shown in FIG. 6, the ground fault detecting circuit 300 is provided with the first and the second transformers 303 and 304 to make the power supply bus line 301 and 302 pass through their toroidal cores. The rectifier 305 has one end A' connected to the load line 301 of the power supply bus line and the other end B' connected to the ground line 302 of the power supply bus line. This rectifier 305 regulates the output of positive voltage at the terminal D' and negative voltage at the terminal C'. The first differential transformer 303 has a primary coil one end of which is connected to the load line of the rectifier 305 and the other connected through the resistor 318 to the ground line of the rectifier 305 and then through the varistor 319 to the load line of the rectifier 305. The second differential transformer 304 has a second coil in which at both ends of the second coil, the capacitor 320 and the load resistor 321 are connected in parallel to each other, and also the current direction control diodes 322 and 323 are connected in parallel to each other, but with their polarities in opposite directions. On the other hand the full wave rectified voltage output from the rectified 305 is applied to the voltage regulator 307. The regulator 307 supplies a predetermined voltage to the invert terminal of the level comparator 308. The level comparator 308 compares the signal of the second differential transformer 304 received from its non-invert terminal with the signal from the voltage regulator 307, to thereby supply the high level or the low level signal to the latch circuit 309. The latch circuit 309 applies the rated high level or low level signal the to gate of the SCR 310. While the signal of the second differential transformer 304 is applied through the resistor 324 to the amplifier 311. Then the amplified signal is applied through the capacitor 312 to the terminal c' of the rectifier 305 and then is supplied to the trip coil 35. The SCR 310 has the anode connected to the front end of the resistor 306 and the cathode connected to the terminal c' of the rectifier 305. Between the anode of the SCR 310 and the terminal c' of the rectifier 305 the capacitor 314 and the resistor 315 are connected in serial to each other. The capacitor 316 has one end connected to the rear of the resistor 306 and other end connected to the terminal c'. One end of the capacitor 313 is connected between the latch circuit 309 and the gate of the SCR 310. The capacitor 317 has one end connected to the latch circuit and other end connected to the terminal c'.

Therefore, the ground fault detecting circuit 300 includes the second differential transformer for sensing the low level ground fault signal and applies this detecting signal to the amplifier 311, while this detecting signal is applied to the non-inverting terminal of the level comparator 308. The level comparator 308 compares this detecting signal with the voltage predetermined by the voltage regulator 307. Then if the ground fault signal is greater than the predetermined voltage signal, the comparator 38 applies the high level signal to the latch circuit 309. The latch circuit 309 latches the high level signal responsive to said high level signal and again supplies the high level signal to the gate of the SCR 310, thereby triggering the SCR 310 into operation. Thus the amplified signal from the amplifier 311 energizes the trip coil 35 and the trip mechanism 200 disengages the power protecting circuit from the power supply source.

As described above, the invention is to provide a receptacle assembly comprised of a simple configuration of a trip mechanism as a leakage interruptor. Therefore, this invention has a marked advantage in that the ground fault detecting circuit and the trip mechanism can instantly interrupt ground faults from the protection circuit by instantaneously responding to current leakages thereby guaranteed maximum protection from ground faults.

What is claimed is:

1. In a ground fault receptacle assembly having a ground fault detecting circuit and a trip mechanism for sensing ground fault signals and for interrupting a protection circuit, said trip mechanism comprising:

a housing having a pair of fixed contacts and a groove therein;

a pushbutton movable in said housing;

a cross bar having a pair of movable contacts;

a pin for connecting said cross bar to said pushbutton, said pin extended into and moving along said groove when said cross bar is moved with the movement of said pushbutton;

a pair of springs connected between said pin and said housing, said springs normally biasing said movable contacts of said cross bar against said fixed contacts of said housing to thereby complete an electrical circuit;

means for normally biasing said cross bar at an angle to thereby separate said movable and said fixed contacts;

a frame secured to said housing;

a trip cross bar movably connected to said frame, said trip cross bar engaging said cross bar to thereby hold said movable and fixed contacts in engagement with one another;

a trip coil connected to said frame and being energized upon the detection of ground fault current; and a trip coil pin movable with respect to said trip coil and connected to said trip cross bar for disengaging said trip cross bar from said cross bar when ground fault current is detected to thereby remove the engagement of said fixed and movable contacts.

2. The ground fault receptable assembly of claim 1, wherein said trip cross bar is rotatable with respect to said frame.

3. The ground fault receptacle assembly of claim 1, wherein said pushbutton is provided with a projection having a groove therein for receiving said pin, said cross bar being coupled with the projection of said pushbutton and being provided with a projection having a hole therein for receiving said pin, and wherein said crossbar comprises a hook member for engaging said cross bar, said hook member including a stopper member to prevent excessive rotation of said trip cross bar toward said cross bar.

4. The ground fault receptacle assembly of claim 1, further comprising means for normally biasing said trip cross bar into engage with said cross bar.

* * * * *